US008070501B2

(12) United States Patent
Kumar et al.

(10) Patent No.: US 8,070,501 B2
(45) Date of Patent: Dec. 6, 2011

(54) ELECTRICAL CONNECTOR WITH ARC SHIELD, PISTON-CONTACT POSITIONER AND ELECTRIC STRESS GRADED INTERFACE

(75) Inventors: Senthil A. Kumar, Copley, OH (US); Todd C. Boggs, Aiken, SC (US)

(73) Assignee: 'Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/822,647

(22) Filed: Jun. 24, 2010

(65) Prior Publication Data

US 2011/0034051 A1 Feb. 10, 2011

Related U.S. Application Data

(60) Provisional application No. 61/213,684, filed on Jul. 2, 2009.

(51) Int. Cl.
*H01R 13/53* (2006.01)

(52) U.S. Cl. ..... 439/186

(58) Field of Classification Search ..... 439/181–187, 439/489, 621, 206
See application file for complete search history.

(56) References Cited

U.S. PATENT DOCUMENTS

| | | | | |
|---|---|---|---|---|
| 3,663,928 | A | 5/1972 | Keto et al. | |
| 3,813,639 | A | 5/1974 | Schurter et al. | |
| 4,082,405 | A | 4/1978 | Stepniak | |
| 4,119,358 | A | 10/1978 | Tachick et al. | |
| 4,186,985 | A * | 2/1980 | Stepniak et al. | 439/185 |
| 4,260,213 | A | 4/1981 | Kotski et al. | |
| 4,260,214 | A | 4/1981 | Dorn | |
| 4,464,004 | A | 8/1984 | Hegyi et al. | |
| 4,773,872 | A * | 9/1988 | Borgstrom et al. | 439/185 |
| 4,863,392 | A | 9/1989 | Borgstrom et al. | |
| 5,277,605 | A * | 1/1994 | Roscizewski et al. | 439/184 |
| 5,393,240 | A | 2/1995 | Makal et al. | |
| 5,445,533 | A * | 8/1995 | Roscizewski et al. | 439/184 |
| 5,525,069 | A * | 6/1996 | Roscizewski et al. | 439/184 |
| 5,573,410 | A | 11/1996 | Stepniak | |
| 5,591,039 | A | 1/1997 | Matthews | |
| 5,655,921 | A | 8/1997 | Makal et al. | |
| 5,795,180 | A | 8/1998 | Siebens | |
| 5,957,712 | A | 9/1999 | Stepniak | |
| 6,068,498 | A | 5/2000 | Strack | |
| 6,168,447 | B1 | 1/2001 | Stepniak et al. | |
| 6,213,799 | B1 | 4/2001 | Jazowski et al. | |
| 6,442,821 | B1 | 9/2002 | Decker | |
| 6,585,531 | B1 | 7/2003 | Stepniak et al. | |
| 6,939,151 | B2 | 9/2005 | Borgstrom et al. | |
| 6,984,791 | B1 | 1/2006 | Meyer et al. | |
| 7,044,760 | B2 | 5/2006 | Borgstrom et al. | |
| 7,044,769 | B2 | 5/2006 | Zhao et al. | |
| 7,059,879 | B2 | 6/2006 | Krause et al. | |
| 7,216,426 | B2 | 5/2007 | Borgstrom et al. | |
| 7,341,468 | B2 * | 3/2008 | Hughes et al. | 439/185 |
| 7,524,202 | B2 | 4/2009 | Stepniak et al. | |
| 2002/0168887 | A1 | 11/2002 | Roscizewski et al. | |

* cited by examiner

*Primary Examiner* — Jean F Duverne
(74) *Attorney, Agent, or Firm* — Alan I. Cantor; Mark S. Bicks; Alfred M. Goodman

(57) ABSTRACT

A high-voltage electrical connector includes a strategically placed barrier that acts as an arc shield to reduce the ionization of materials during load break switching, reducing or preventing flashover. An electric stress graded interface design also reduces switching flashover and reduces the fault close energy. Mating features on the piston-contact element and inside the surrounding container accurately guide the piston-contact element as it travels along the container.

40 Claims, 5 Drawing Sheets

ELECTRICAL CONNECTOR WITH ARC SHIELD, PISTON-CONTACT POSITIONER AND ELECTRIC STRESS GRADED INTERFACE

CROSS-REFERENCE TO RELATED APPLICATION

This application claims the benefit of provisional application No. 61/213,684, filed Jul. 2, 2009, which is incorporated by reference herein in its entirety.

FIELD OF THE INVENTION

The present invention generally relates to an electrical connector for a high voltage power distribution system. More specifically, the invention relates to an electrical connector, such as a bushing insert, having a snuffer tube assembly including a piston-contact element that moves between retracted and extended positions.

BACKGROUND OF THE INVENTION

Conventional high voltage electrical connectors, such as bushing inserts, connect devices such as transformers to the electrical equipment of a power distribution system. Typically the electrical connector is joined to another electrical device of the power distribution system, such as an elbow cable connector, with female contacts of the electrical connector mating with male contacts of the cable connector. An exemplary operating voltage for such connectors is 25 KV. Safe use and efficient performance of such connectors depends on a combination of factors.

When the electrical connector and the cable connector are joined under a load (load make switching), an arc is struck between the contacts as they approach one another. This arc is acceptable since it is generally of moderate intensity and is quenched as soon as the contact elements are engaged. However, during load break switching, as the contacts of the electrical connector and the cable connector are separated under load, ionization of materials and/or local dielectric breakdown can occur, leading to flashover. Further, during fault closure or short circuit conditions, a substantial arc can occur between the contacts, possibly resulting in catastrophic failure of the electrical connector.

Conventional electrical connectors employ a piston, which is attached to the female contact of the electrical connector. During fault conditions the piston is forced by the pressure of ablative arc-quenching gases to rapidly move the female contact into engagement with the male contact of the cable connector, thereby minimizing the arc formed therebetween. See, e.g., U.S. Pat. No. 7,059,879 to Krause and Zhao, which is incorporated herein by reference. Current piston-contact arrangements, and existing measures such as venting that address flashover, leave room for improvement.

SUMMARY OF THE INVENTION

The electrical connector of the invention includes a strategically placed barrier that acts as an arc shield to reduce the ionization of materials during load break switching, reducing or preventing flashover. In addition, an electric stress graded interface design reduces switching flashover and reduces the fault close energy. Further, mating features on the piston-contact element and inside the surrounding container accurately guide the piston-contact element as it travels along the container.

According to one aspect, the invention is directed to a high-voltage bushing insert for mating with a cable connector, comprising a housing including an inner bore and an open front end, and a snuffer load break assembly slidably received in the inner bore of the housing. The snuffer load break assembly comprises a snuffer tube having an inner cavity, a front open end providing cable connector access to the inner cavity, and a rear end opposite the front end; a contact in the inner cavity having a rear portion in contact with and affixed to the snuffer tube and a front portion radially spaced from said snuffer tube; an annular arc shield in the inner cavity affixed to the snuffer tube and surrounding at least part of the front portion of the contact; and a piston attached to the contact at the rear end of the snuffer tube.

The front portion of the contact has a proximal region adjacent the rear portion of the contact, and a distal region adjacent the proximal region. In one embodiment, the arc shield surrounds at least a portion of the proximal region of the contact, preferably does not surround the distal region, and preferably comprises a layer of silicone rubber applied to the inner surface of the snuffer tube. In another embodiment, the arc shield surrounds at least a portion of the distal region of the contact, preferably does surround the proximal region, and preferably comprises a tubular member made of high-temperature resistant material.

The contact preferably has an annular shoulder that abuts the rear end of the snuffer tube. The radially outer surface of piston and the inner surface of the inner bore preferably have mating longitudinal guide elements. The electrical conductivity of the housing preferably increases in successive regions starting at the open front end of the housing and progressing rearward. Additional preferred features and advantages of the invention will be apparent from the following detailed description.

BRIEF DESCRIPTION OF THE DRAWINGS

A preferred embodiment of the invention is described in detail below, purely by way of example, with reference to the accompanying drawing, in which.

DETAILED DESCRIPTION OF THE INVENTION

As used in this application, terms such as "front," "rear," "side," "top," "bottom," "left," "right," "above," "below," "upwardly" and "downwardly" are intended to facilitate the description of the invention, and are not intended to limit the structure of the invention to any particular position or orientation.

Figure 1:
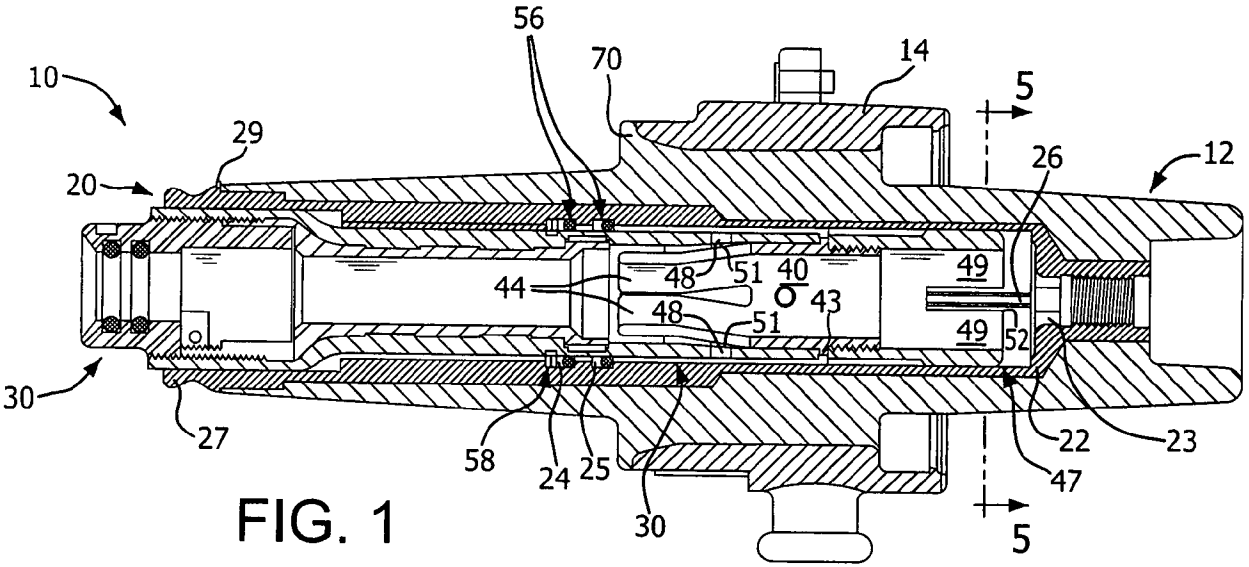
FIG. 1 is a side elevational view in cross-section of an electrical connector in the form of a bushing insert having an arc shield according to a first embodiment of the invention.
Figure 4:
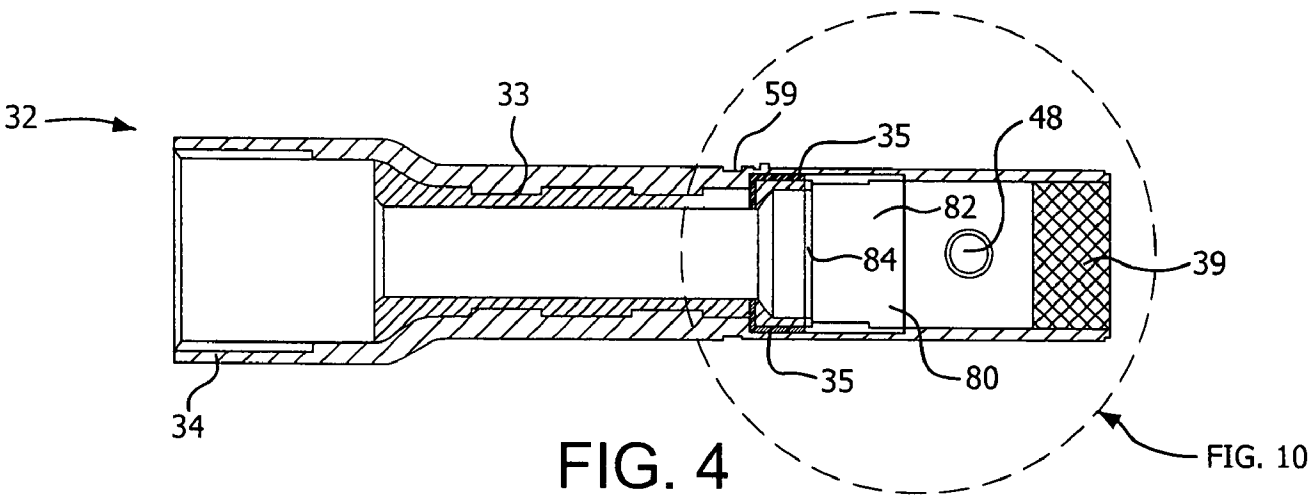
FIG. 4 is a side elevational view in cross-section of a snuffer tube of the electrical connector of FIG. 1, but having an arc shield according to a second embodiment of the invention.

Referring to FIG. 1, an electrical connector in the form of a bushing insert 10 comprises a molded unitary housing 12 formed of an insulating rubber surrounded in its middle portion by an outer layer 14 made of a conductive rubber, which is connected to ground. Housing 12 is molded around a nose cone assembly 20 (see FIG. 2), which houses a slidable, gas-driven snuffer load break assembly 30 (see FIG. 4). Operation of the snuffer load break assembly is similar to that described in U.S. Pat. No. 7,059,879.

Figure 2:
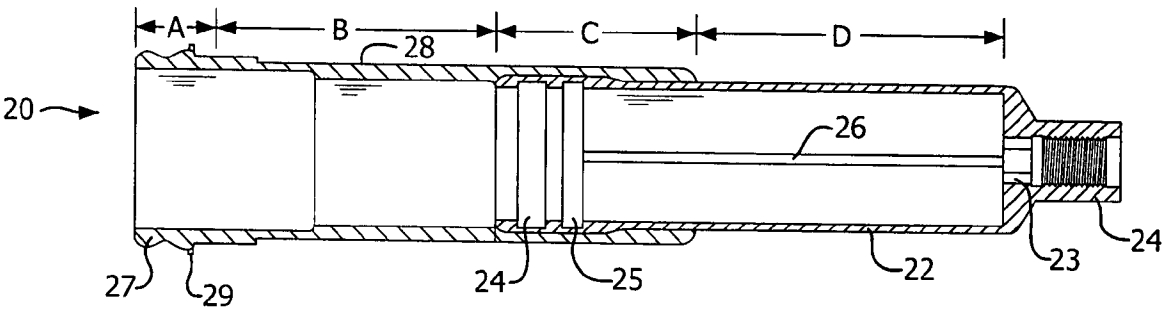
FIG. 2 is a side elevational view in cross-section of the nose cone assembly of the electrical connector of FIG. 1.

Referring to FIG. 2, nose cone assembly 20 comprises a copper container 22 having at one end a hexagonal well leading to an internally threaded nipple 24 for connection to a universal bushing well, as is well known and conventional in the art. The opposite end has a slightly thicker wall section in which two internal circumferential O-ring grooves 24, 25 are formed. Three internal parallel guide ribs 26 extend longitudinally of the container at equally spaced circumferential positions. Overmolded on the grooved end of container 22 is a high-permittivity nose cone 27, preferably made of a 30% glass-reinforced type 66 nylon, such as LNP RF-1006. Copper container 22 has a low profile, i.e., it is relatively short as compared to piston-contact element containers used in existing bushing inserts. Specifically, container 22 preferably has an overall length of about 4.720 in., the internal length of its main cylindrical body being about 3.850 in. The overall length of nose cone assembly 20 preferably is about 7.434 in.; the length of nose cone 27 is preferably about 4.214 in.; and the overmolded portion of nose cone 27 (the portion that overlaps container 22) preferably is about 1.500 in. The left end of nose cone 27 has four circumferentially spaced, axially directed notches (not shown).

The bushing insert has an electrical stress graded interface design, as follows. The conductive length of nose cone assembly 20 embraces several diverse regions. Starting at the left end of FIG. 2, region A, about 0.464 in. long, solely is the high-permittivity material of nose cone 27. Region B, about 2.250 in. long, is the high-permittivity material of nose cone 27 and an electrically conductive adhesive outer layer 28, e.g., Chemlok® EP6804-22, which extends from a line spaced about 0.180 in. from shoulder 29 (which abuts the left end of housing 12—see FIG. 1) to the vicinity of the grooved end of container 22. Region C, about 1.500 in. long, is the moderately conductive material of nose cone 27 and the contiguous highly conductive copper container 22, spanning about 38.96% of the internal length of the container. Region D, about 2.350 in. long, solely is the highly conductive copper container 22, covering about 61.04% of its internal length. These regions thus comprise the following approximate percentages of the total conductive length A+B+C+D of the inner bore of nose cone assembly 20: A≈7.0%; B≈34.3%; C≈22.9%; D≈35.8%. These stress grading features collectively reduce switching flashover and reduce the fault close energy, making use of the bushing insert safer for field operations.

Figure 3:
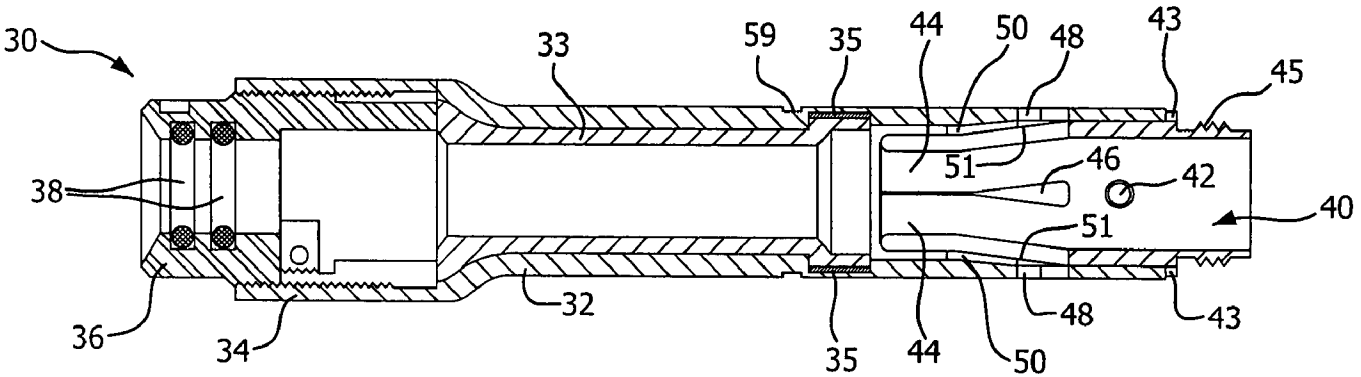
FIG. 3 is a side elevational view in cross-section of the snuffer load break assembly of the electrical connector of FIG. 1 (piston omitted)

Referring to FIG. 3, snuffer load break assembly 30 comprises a snuffer tube 32 made of filament-wound epoxy resin fiberglass surrounding an ablative material 33. An internal annular rubber seal 35, applied prior to winding, resides in the right-hand transition section of snuffer tube 32. After winding, the snuffer tube is externally coated, preferably with a polyurethane varnish. One end 34 of snuffer tube 32 is flared and internally threaded to mate with an externally threaded gas trap 36 having two O-rings 38 that seal against the male contact of a cable connector. The other end of snuffer tube 32 is internally roughened at 39 for adhesive bonding to female contact 40, which is further secured to the snuffer tube by two opposed rivets 42. A contact positioning collar 43 on female contact 40 has an annular shoulder that abuts the end of snuffer tube 32, ensuring accurate location of contact 40 when it is being bonded and riveted to the snuffer tube, and ensuring effective transfer of pistonic force to the end of the snuffer tube.

Contact 40 has four resilient fingers 44 separated by four triangular gaps 46 in the proximal region of the fingers. Two opposed vent holes 48 in snuffer tube 32 are aligned with two of these gaps. The opposite end 45 of contact 40 is threaded for attachment to a copper piston 47 (see FIG. 1), which has three fingers 49 at its wider end, separated by longitudinal slots 52, that slidably contact the interior of container 22. A non-ablative arc shield is installed between the inner surface of snuffer tube 32 and female contact 40. The arc shield reduces the ionization of materials during load break switching, reducing or preventing flashover.

Figure 10:
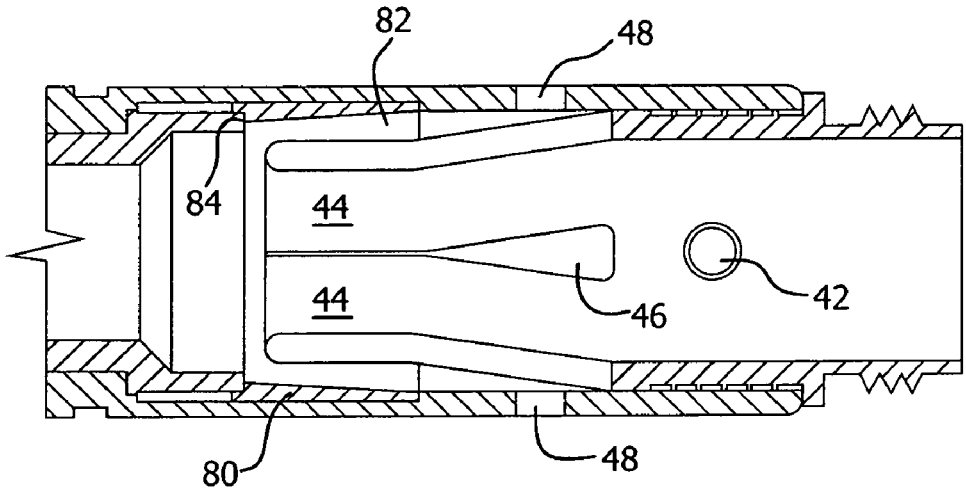
FIG. 10 is a detail view of a portion of FIG. 4 showing the arc shield according to the second embodiment of the invention.
Figure 11:
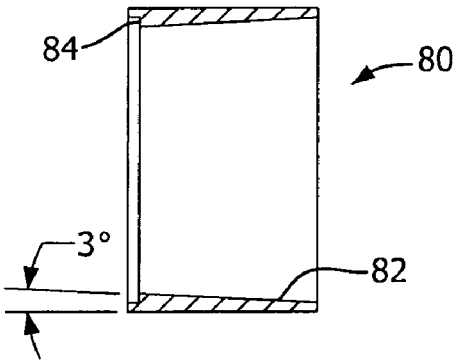
FIG. 11 is a side elevational view in section of the arc shield shown in FIG. 10.
Figure 12:
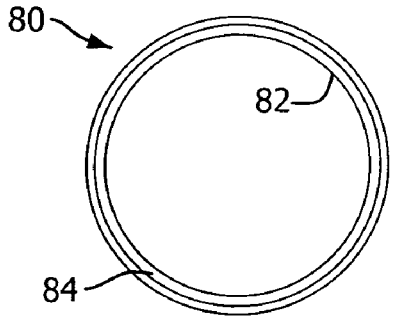
FIG. 12 is a left end elevational view of the arc shield of FIG. 11.

In one embodiment, shown in FIG. 3, the arc shield can take the form of a thin annular coating of silicone rubber 50 applied to snuffer tube 32 adjacent the proximal region of fingers 44, ending short of the distal ends of fingers 44. Arc shield 50 is interrupted by holes 51, which are aligned with vent holes 48. In other embodiments, illustrated by the example shown in FIGS. 10-12, the arc shield can take the form of a tubular insert 80 of plastic, ceramic, glass or other high-temperature-resistant material that is wrapped into the snuffer tube 32 and surrounds the distal portion of fingers 44 up to about the location where the gaps 46 begin. A preferred material for arc shield insert 80 is 30% glass-reinforced nylon 66. The inner wall 82 of arc shield insert 80 preferably is tapered at about 3° toward the rear end of the snuffer tube. Arc shield insert 80 also preferably has an annular recess 84 at the front end thereof, which is filled by ablative material 33.

Figure 5:
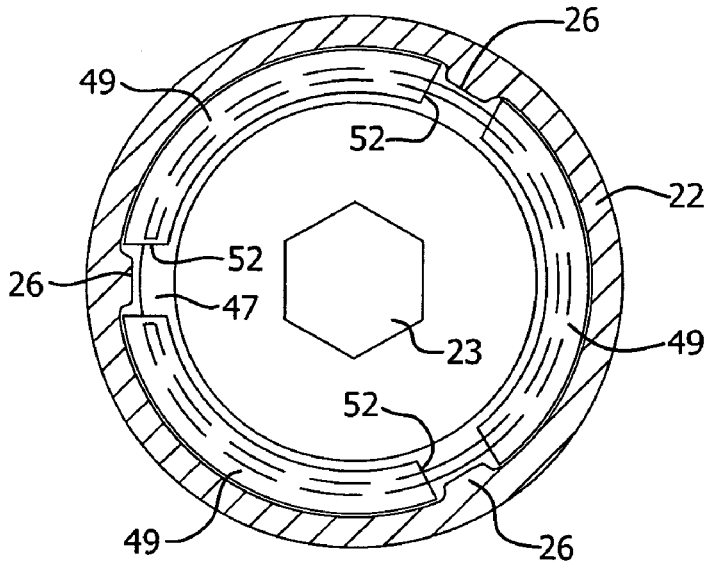
FIG. 5 is a cross-sectional view through the electrical connector taken along line 5-5 in FIG. 1 (omitting the external housing)
Figure 9:
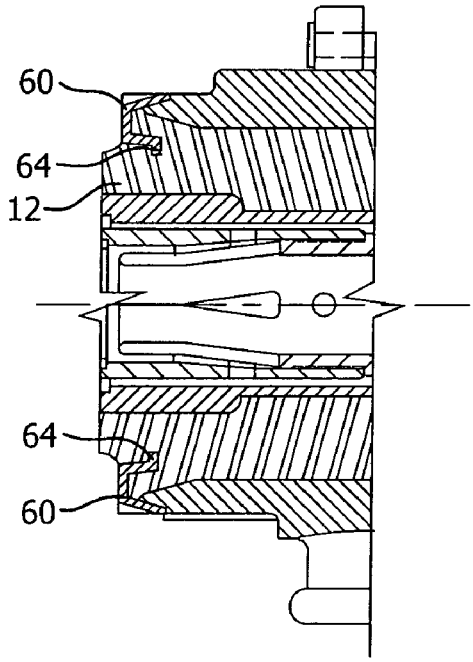
FIG. 9 is a side elevational view in cross-section of the central section of the electrical connector of FIG. 1, showing the interface between the safety ring and the housing.
Figure 6:
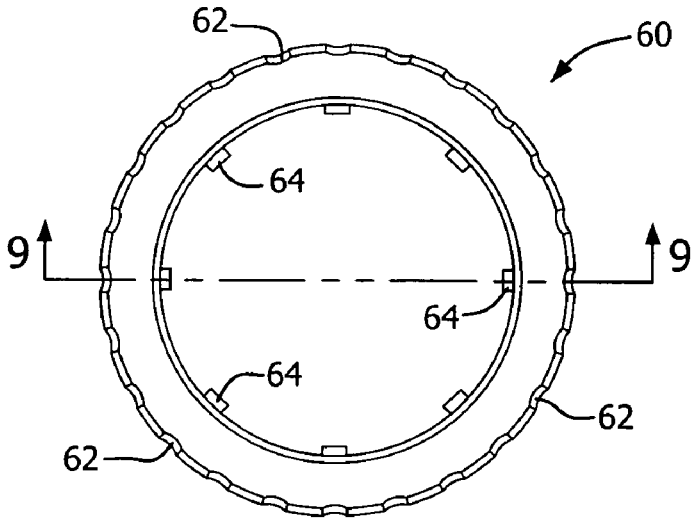
FIG. 6 is a top plan view of the safety ring of the electrical connector of FIG. 1.
Figure 7:
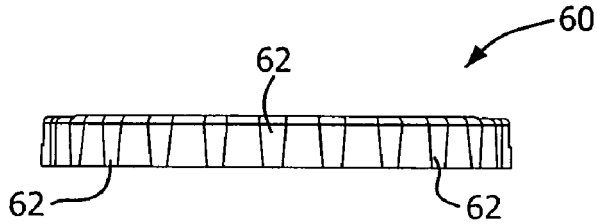
FIG. 7 is a side elevational view of the safety ring of FIG. 6.
Figure 8:
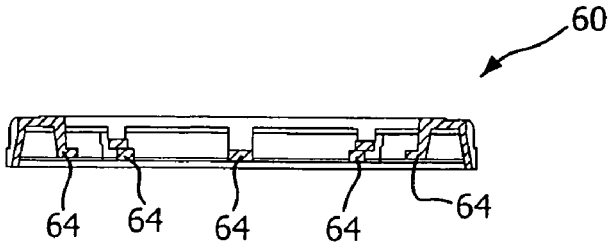
FIG. 8 is a side elevational view in cross-section of the safety ring taken along 8-8 in FIG. 7.

As is known in the art, arc-quenching gases emanating from ablative materials in the cable connector and the bushing insert rapidly drive the piston 47 and the attached snuffer load break assembly 30, which includes female contact 40, along the length of container 22 toward the male contact of the cable connector. See, e.g., U.S. Pat. No. 7,059,879. As seen in FIGS. 1 and 5, guide ribs 26 on the interior of container 22 fit within the longitudinal slots 52 of piston 47. This arrangement essentially eliminates any skewing of the piston, thus accurately and smoothly guiding the entire snuffer load break assembly 30 as it moves along the container 22. O-rings 56 in grooves 24, 25 seal the sliding interface between snuffer tube 32 and the inside of container 22. A resilient retaining ring 58 in groove 24 cooperates with an external groove 59 on snuffer tube 32 essentially in the manner described in U.S. Pat. No. 7,059,879.

FIGS. 6-9 depict a vented safety ring 60, which is adapted to vent the interface between the bushing insert and the cable connector and provide a visual indication of an incomplete or improper connection of those components. Exemplary safety rings of the prior art are disclosed in U.S. Pat. Nos. 6,213,799; 6,585,531; and 7,044,769, all of which are incorporated herein by reference. Safety ring 60 is adapted for attachment to the transition shoulder 70 of housing 12 (see FIG. 1). It is molded from a suitable rubber or plastic material having a bright color, such as yellow, which contrasts with the colors of the bushing insert and the cable connector. If the connection between the bushing insert and the cable connector is fully made, the safety ring is completely covered by the cuff of the cable connector. If, however, the connection is not complete, a portion of the safety ring will be exposed, readily revealing the improper assembly.

Safety ring 60 has peripheral grooves 62 for venting the interface between the bushing insert and the cable connector. It also has eight inwardly projecting anchoring feet 64. The safety ring is positioned during molding of the insulating rubber housing 12 so that the anchoring feet 64 are surrounded by the molded rubber material, thus mechanically retaining the safety ring in position. If desired, a layer of adhesive may be applied between the safety ring and the housing for a more secure attachment. Alternatively, the anchoring feet can be omitted, and the safety ring can be bonded with adhesive onto the housing.

While various embodiments have been chosen to illustrate the invention, it will be understood by those skilled in the art that various changes and modifications may be made without departing from the scope of the invention as defined by the appended claims.

We claim:

1. A high-voltage bushing insert for mating with a cable connector, comprising:

a housing including an inner bore and an open front end; and a snuffer load break assembly slidably received in said inner bore of said housing and comprising:

a snuffer tube having an inner cavity, a front open end providing cable connector access to said inner cavity, and a rear end opposite said front end, a contact in said inner cavity having a rear portion in contact with and affixed to said snuffer tube, and a front portion radially spaced from said snuffer tube, an annular arc shield in said inner cavity affixed to said snuffer tube and radially surrounding at least part of said front portion of said contact, and a piston attached to said contact at said rear end of said snuffer tube.

2. A high-voltage bushing insert according to claim 1, wherein said contact has an annular shoulder outside said inner cavity that abuts said rear end of said snuffer tube.

3. A high-voltage bushing insert according to claim 2, wherein said rear portion of said contact has a longitudinal extension outside said inner cavity and adjacent said annular shoulder, and said piston is attached to said extension.

4. A high-voltage bushing insert according to claim 3, wherein said piston and said extension are threadably connected.

5. A high-voltage bushing insert according to claim 4, wherein the radially outer surface of said piston and the surrounding inner surface of said inner bore have mating longitudinal guide elements.

6. A high-voltage bushing insert according to claim 5, wherein said guide elements comprise slots in said piston and ribs on said inner bore.

7. A high-voltage bushing insert according to claim 1, wherein said front portion of said contact has a plurality of cantilevered, longitudinally extending resilient fingers; and wherein said arc shield surrounds at least part of said fingers.

8. A high-voltage bushing insert according to claim 7, wherein said fingers are separated by gaps in a proximal region adjacent said rear portion of said contact; and wherein said arc shield surrounds said fingers in said proximal region.

9. A high-voltage bushing insert according to claim 8, wherein said arc shield does not surround the distal portions of said fingers.

10. A high-voltage bushing insert according to claim 8, wherein said arc shield comprises a layer of silicone rubber applied to the inner surface of said snuffer tube.

11. A high-voltage bushing insert according to claim 8, wherein said snuffer tube has at least one vent hole aligned with one of said gaps; and wherein said arc shield has a hole aligned with said at least one vent hole.

12. A high-voltage bushing insert according to claim 7, wherein said fingers are separated by gaps in a proximal region adjacent said rear portion of said contact; and wherein said arc shield surrounds the distal portions of said fingers but does not surround said proximal region.

13. A high-voltage bushing insert according to claim 12, wherein said arc shield comprises a tubular member made of high-temperature-resistant material.

14. A high-voltage bushing insert according to claim 13, wherein said tubular member is radially spaced from said fingers.

15. A high-voltage bushing insert according to claim 14, wherein said tubular member has an annular wall that tapers toward said rear end of said snuffer tube.

16. A high-voltage bushing insert according to claim 14, wherein said tubular member has an annular recess that faces toward said front end of said snuffer tube.

17. A high-voltage bushing insert according to claim 1, wherein said front portion of said contact has a proximal region adjacent said rear portion of said contact and a distal region adjacent said proximal region; and wherein said arc shield surrounds at least a portion of said proximal region.

18. A high-voltage bushing insert according to claim 17, wherein said arc shield does not surround said distal region.

19. A high-voltage bushing insert according to claim 18, wherein said arc shield comprises a layer of silicone rubber applied to the inner surface of said snuffer tube.

20. A high-voltage bushing insert according to claim 1, wherein said front portion of said contact has a proximal region adjacent said rear portion of said contact and a distal region adjacent said proximal region; and wherein said arc shield surrounds at least a portion of said distal region.

21. A high-voltage bushing insert according to claim 20, wherein said arc shield does not surround said proximal region.

22. A high-voltage bushing insert according to claim 21, wherein said arc shield comprises a tubular member made of high-temperature-resistant material.

23. A high-voltage bushing insert according to claim 22, wherein said tubular member is radially spaced from said distal region.

24. A high-voltage bushing insert according to claim 23, wherein said tubular member has an annular wall that tapers toward said rear end of said snuffer tube.

25. A high-voltage bushing insert according to claim 1, wherein the electrical conductivity of said housing varies along its length.

26. A high-voltage bushing insert according to claim 25, wherein the electrical conductivity of said housing successively increases from the open end thereof in successive regions comprising:

a first region starting at the open end of the housing spanning about 7.0% of the total length of said inner bore;

a second region adjacent said first region and spanning about 34.3% of the total length of said inner bore;

a third region adjacent said second region and spanning about 22.9% of the total length of said inner bore; and a fourth region adjacent said third region and spanning about 35.8% of the total length of said inner bore.

27. A high-voltage bushing insert according to claim 26, wherein said housing comprises:

a highly conductive metallic rear tubular member, a front tubular member made of a high permittivity material having an open front end and a rear portion that overlaps a front portion of said rear tubular member, and an electrically conductive adhesive layer on the outside of said front tubular member extending from a location near said open front end of said front tubular member to the location where said front tubular member and said rear tubular member begin to overlap; and wherein said first region begins at the open end of said front tubular member and ends where the adhesive layer begins, said second region spans the length of said adhesive layer, said third region spans the overlapped length of said front and rear tubular members, and said fourth region spans the remainder of the length of said inner bore.

28. A high-voltage bushing insert according to claim 1, wherein said housing comprises:

a highly conductive metallic rear tubular member, a front tubular member made of a high permittivity material having an open front end and a rear portion that overlaps a front portion of said rear tubular member, and an electrically conductive adhesive layer on the outside of said front tubular member extending from a location near said open front end of said front tubular member to the location where said front tubular member and said rear tubular member begin to overlap; and wherein the electrical conductivity of said housing increases from the open end thereof along the length of its inner bore in successive regions comprising:

a first region that begins at the open end of said front tubular member and ends where the adhesive layer begins, second region that spans the length of said adhesive layer, a third region that spans the overlapped length of said front and rear tubular members, and a fourth region that spans the remainder of the length of said inner bore.

29. A high-voltage bushing insert for mating with a cable connector, comprising:

a housing including an inner bore, an open front end and longitudinal guide elements on an inner surface of said inner bore, the housing having an electrical conductivity that increases along its length starting at said open front end, and a snuffer load break assembly slidably received in said inner bore of said housing and comprising:

a snuffer tube having an inner cavity, a front open end providing cable connector access to said inner cavity, and a rear end opposite said front end;

a contact in said inner cavity having a rear portion in contact with and affixed to said snuffer tube, a front portion radially spaced from said snuffer tube, and an annular shoulder outside said inner cavity that abuts said rear end of said snuffer tube;

an annular arc shield in said inner cavity affixed to said snuffer tube and radially surrounding at least part of said front portion of said contact; and a piston attached to said contact at said rear end of said snuffer tube and having longitudinal guide elements on a radially outer surface thereof that mate with said longitudinal guide elements on said inner surface of said inner bore.

30. A high-voltage bushing insert according to claim 29, wherein said front portion of said contact has a proximal region adjacent said rear portion of said contact and a distal region adjacent said proximal region; and wherein said arc shield surrounds at least a portion of said proximal region.

31. A high-voltage bushing insert according to claim 30, wherein said arc shield does not surround said distal region.

32. A high-voltage bushing insert according to claim 31, wherein said arc shield comprises a layer of silicone rubber applied to the inner surface of said snuffer tube.

33. A high-voltage bushing insert according to claim 29, wherein said front portion of said contact has a proximal region adjacent said rear portion of said contact and a distal region adjacent said proximal region; and wherein said arc shield surrounds at least a portion of said distal region.

34. A high-voltage bushing insert according to claim 33, wherein said arc shield does not surround said proximal region.

35. A high-voltage bushing insert according to claim 34, wherein said arc shield comprises a tubular member made of high-temperature-resistant material.

36. A high-voltage bushing insert according to claim 35, wherein said tubular member is radially spaced from said distal region.

37. A high-voltage bushing insert according to claim 36, wherein said tubular member has an annular wall that tapers toward said rear end of said snuffer tube.

38. A high-voltage bushing insert according to claim 29, wherein said housing comprises:

a highly conductive metallic rear tubular member, a front tubular member made of a high permittivity material having an open front end and a rear portion that overlaps a front portion of said rear tubular member along an overlapped length of said front and rear tubular members, and an electrically conductive adhesive layer on the outside of said front tubular member extending from a location near said open front end of said front tubular member to the location where said front tubular member and said rear tubular member begin to overlap; and wherein said electrical conductivity of said housing increases along its length in successive regions comprising:

a first region that begins at said open front end of said front tubular member and ends where said adhesive layer begins, a second region that spans the length of said adhesive layer, a third region that spans said overlapped length of said front and rear tubular members, and a fourth region that spans the remainder of the length of said inner bore.

39. A high-voltage bushing insert according to claim 29, wherein said arc shield is non-ablative.

40. A high-voltage bushing insert according to claim 1, wherein said arc shield is non-ablative.

* * * * *